US005819947A

United States Patent [19]

Nardi et al.

[11] Patent Number: 5,819,947

[45] Date of Patent: Oct. 13, 1998

[54] CLASSIFIER CAGE FOR ROTATING MILL PULVERIZERS

[75] Inventors: John Anthony Nardi, Clinton Township, Mich.; Rickey E. Wark, Longview, Tex.

[73] Assignee: Sure Alloy Steel Corporation, Madison Heights, Mich.

[21] Appl. No.: 591,933

[22] Filed: Jan. 29, 1996

[51] Int. Cl.[6] ..... B07B 7/083

[52] U.S. Cl. ..... 209/139.2; 209/714; 241/119; 241/79.1

[58] Field of Search ..... 209/139.2, 713, 209/714, 715, 718, 148; 241/80, 81, 79, 79.1, 79.3, 53, 61, 119

[56] References Cited

U.S. PATENT DOCUMENTS

| | | | |
|---|---|---|---|
| 1,963,469 | 6/1934 | Kuhr | 209/139.2 |
| 4,192,469 | 3/1980 | Jager | 241/79.3 X |
| 4,470,902 | 9/1984 | Yoshimori | 209/713 X |
| 4,653,699 | 3/1987 | Schlessing | 209/713 X |
| 4,694,994 | 9/1987 | Henne et al. | 241/79.1 |
| 4,721,258 | 1/1988 | Dougan et al. | 241/119 X |
| 4,982,905 | 1/1991 | Holsiepe et al. | 241/119 X |
| 5,251,831 | 10/1993 | Yoshida et al. | 241/79.1 |
| 5,263,655 | 11/1993 | Giammaruti et al. | 241/119 |
| 5,381,968 | 1/1995 | Lohnherr et al. | 241/79.1 X |
| 5,533,629 | 7/1996 | Ito et al. | 209/714 |

*Primary Examiner*—D. Glenn Dayoan
*Attorney, Agent, or Firm*—Young & Basile, P.C.

[57] ABSTRACT

An improved classifier cage for bowl mill type coal pulverizers which have been converted from stationary throats to rotating throats with reversed flow direction. The direction of the classifier vanes is reversed such that the rotational flow direction of coal/air from the rotating throat is generally maintained as it passes through the classifier cage into a classifier cone, rather than being reversed in "U-turn" fashion. A further improvement is made in the geometry of the classifier vanes to create a better downward and tangential redirection of the flow into the classifier cone.

13 Claims, 7 Drawing Sheets

40
44
36
34
32
30
42
38
28
14
20
20
24
10
12
16
26
18

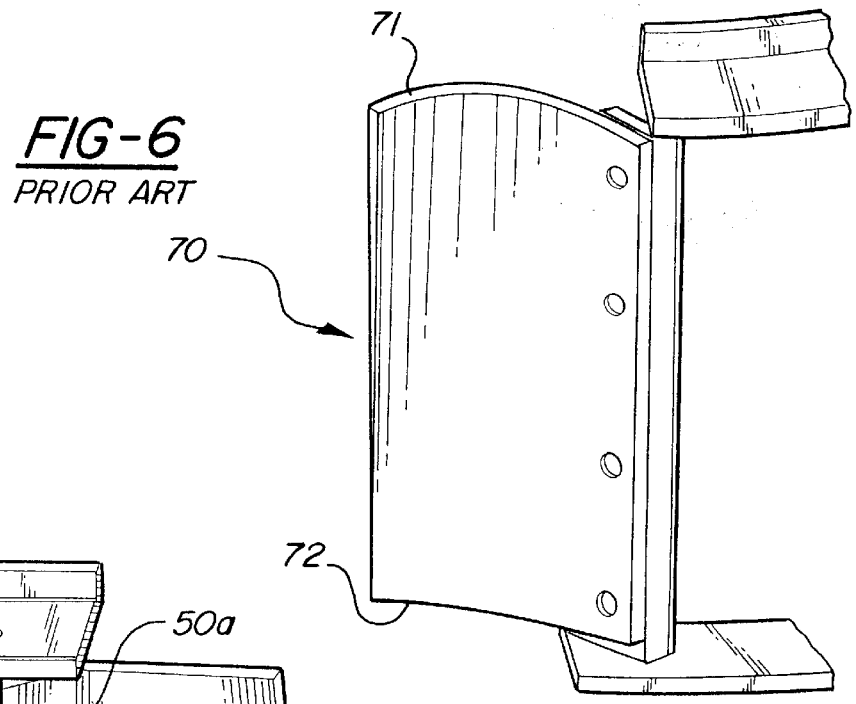
FIG-6
PRIOR ART
FIG-7
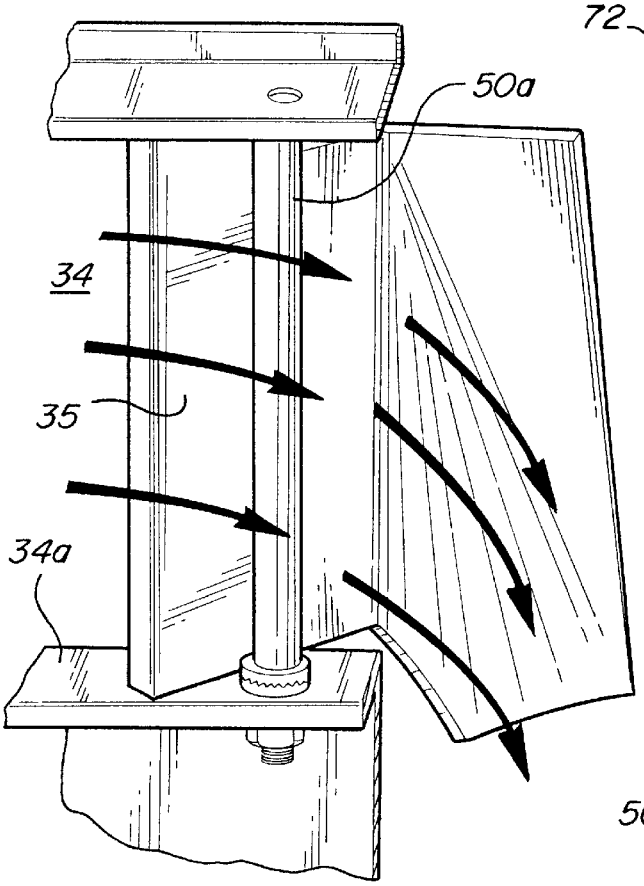
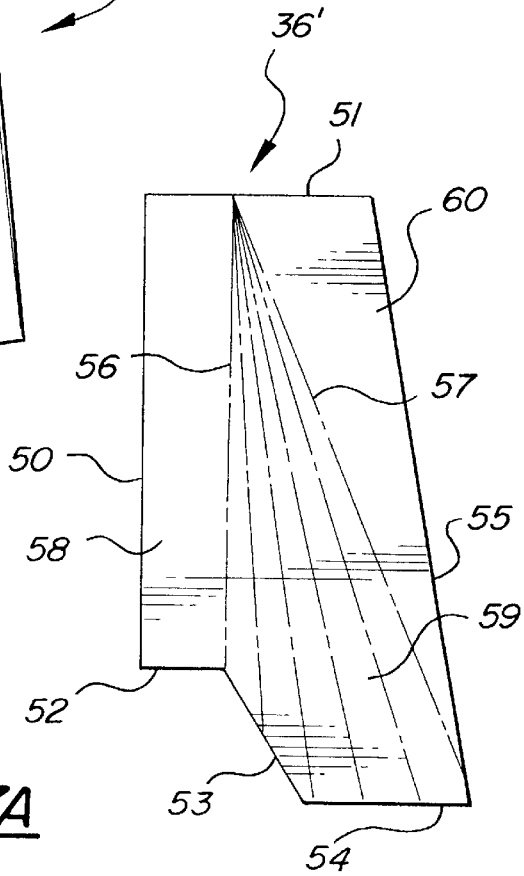
FIG-7A

CLASSIFIER CAGE FOR ROTATING MILL PULVERIZERS

FIELD OF THE INVENTION

The present invention relates to bowl mill type coal pulverizers, and more particularly to the classifier cages found at the upper ends of such pulverizers for redirecting a flow of pulverized coal fines into a classifier cone.

BACKGROUND OF THE INVENTION

Coal pulverizers are extensively used in the power-generating industry to process coal into finely ground "fines" suitable for combustion. A common type of pulverizer is the bowl mill pulverizer, in which a bowl- or ring-shaped grinding plate is rotated while heavy grinding wheels crush and grind coal fed onto the plate from a feedpipe. Typically, a circular "throat" surrounds the outer edge of the grinding plate, and a stream of forced air is blown upward around the grinding plate to entrain the ground coal into a flow which spirals up and around the pulverizer into a classifier cone. Once in the classifier cone, the coal/air flow should be directed to swirl down into the classifier cone with a centrifugal classifying action, with the smaller coal fines separated up and out for combustion, and with larger coal particles not suitable for combustion swirled around the sides of the cone to eventually drop back into the pulverizer for regrinding.

The classifier cones are typically provided at their upper end with a circular classifier cage defining a circumferential inlet for the cone, the cage being filled with a number of classifier vanes which are used to direct the coal/air flow into the cone in a desired swirl pattern. Control over this swirl pattern is critical in maximizing control of the cone's classifying action, and the resulting fineness of the coal being burned.

The initial rotational direction of the coal/air flow around the pulverizer is imparted by a number of angled throat vanes in the throat, and subsequently modified by the classifier vanes to flow down and around inside the classifier cone. In the past, pulverizer throats have typically been stationary. Recently, however, the industry has been converting from stationary to rotating throats to improve flow efficiency from the throat. U.S. Pat. No. 4,721,258 to Dougan et al. describes a number of reasons for conversion from stationary to rotating throats. The Dougan et al. patent discloses an arrangement of pulverizer throat vanes (FIG. 4) in which the rotating throat vanes are oriented in the direction of rotation of the bowl and throat. This orientation is intended to take advantage of a specially-shaped throat vane having an airfoil portion.

However, it has since been found that orienting the throat vanes opposite the direction of bowl/throat rotation is far more efficient, and has generally become the industry standard for rotating throat pulverizers. This results in a corresponding reversed rotation of the flow that reaches the classifier cage from the pulverizer throat.

Adjustment of the flow through the classifier cage is achieved with one of two types of adjustable vanes: fixed pitch vanes with lengthwise adjustable slide plates, and pivot-type vanes. The slide- and pivot-adjustments are intended to improve control over the flow into the classifier cone.

Prior art classifier vanes with lengthwise adjustments have been found not to help fineness control since they do not adjust tangential flow direction with respect to the interior surface of the cone. The pivot-type vanes offer better control over flow direction, using individual pivot adjustments or linkages to articulate sets of multiple vanes at the same time. However, pivoting alone is not sufficient to optimize directional control over the flow. Accordingly, some prior art vanes are additionally curved to help redirect flow.

SUMMARY OF THE INVENTION

Despite the above-described attempts to achieve optional directional control over the flow from the pulverizer throat, the prior art has failed to recognize that the coal/air flow entering the classifier cage must typically make a U-turn through the vanes, reversing direction. The prior art vane adjustment systems and shape modifications have accordingly not been able to compensate for the loss of classifying velocity and flow control.

In its broadest form, the invention is a classifier cage of the general type described above, wherein the flow direction of the classifier vanes is reversed to match the rotational flow from a rotating pulverizer throat with reversed flow direction. This has been found to significantly increase the velocity of the coal fines entering the classifier cone for improved classification, and further to improve directional control over the fines entering the classifier cone so that a more centrifugal classifying action is possible.

In a further form the invention comprises an improved classifier vane geometry, in which the vane is generally trapezoidal with a longer lower edge. By "trapezoidal" we mean shapes in which the interior or free edge of the vane is extended in angular fashion into the classifier such that it widens toward its lower end. This includes both true rectangular trapezoids, as well as other similar shapes. The vane is additionally bent or curved over a major portion to direct coal tangentially toward the interior surface of the classifier cone, and in a preferred form is extended down into the cone below the level of the classifier cage inlet. In a further preferred form, the vane has two primary angled portions: a funnel-like center region which widens from top to bottom; and, an outer deflector region which is set at a second, greater angle and which narrows from top to bottom to provide an initial downward redirection of flow without interfering with the tangential throw of coal from the lower edge of the vane.

The result is a vane which better controls and guides the flow of coal as it initially enters the classifier to a release point which is essentially tangential to the interior wall of the classifier cone.

While the preferred use of the improved classifier vanes is with the improved classifier vane orientation for reversed-flow rotating throats, it is likewise useful for improving the classifier operation in cooperation with stationary throats and rotating throats with non-reversed flow.

The invention is also a method for improving the flow of coal fines through a classifier cage in a bowl mill type coal pulverizer which has a rotating throat with reversed flow direction, comprising the step of reversing the orientation of classifier vanes in the classifier cage such that they are oriented in a rotational direction generally aligned with the rotational direction of coal/air flow from the rotating throat.

These and other features and advantages of the invention will become apparent upon further reading of the specification.

BRIEF DESCRIPTION OF THE DRAWINGS

FIG. 6 is a perspective front view of a prior art curved classifier vane;

DETAILED DESCRIPTION OF THE DRAWINGS

Figure 1:
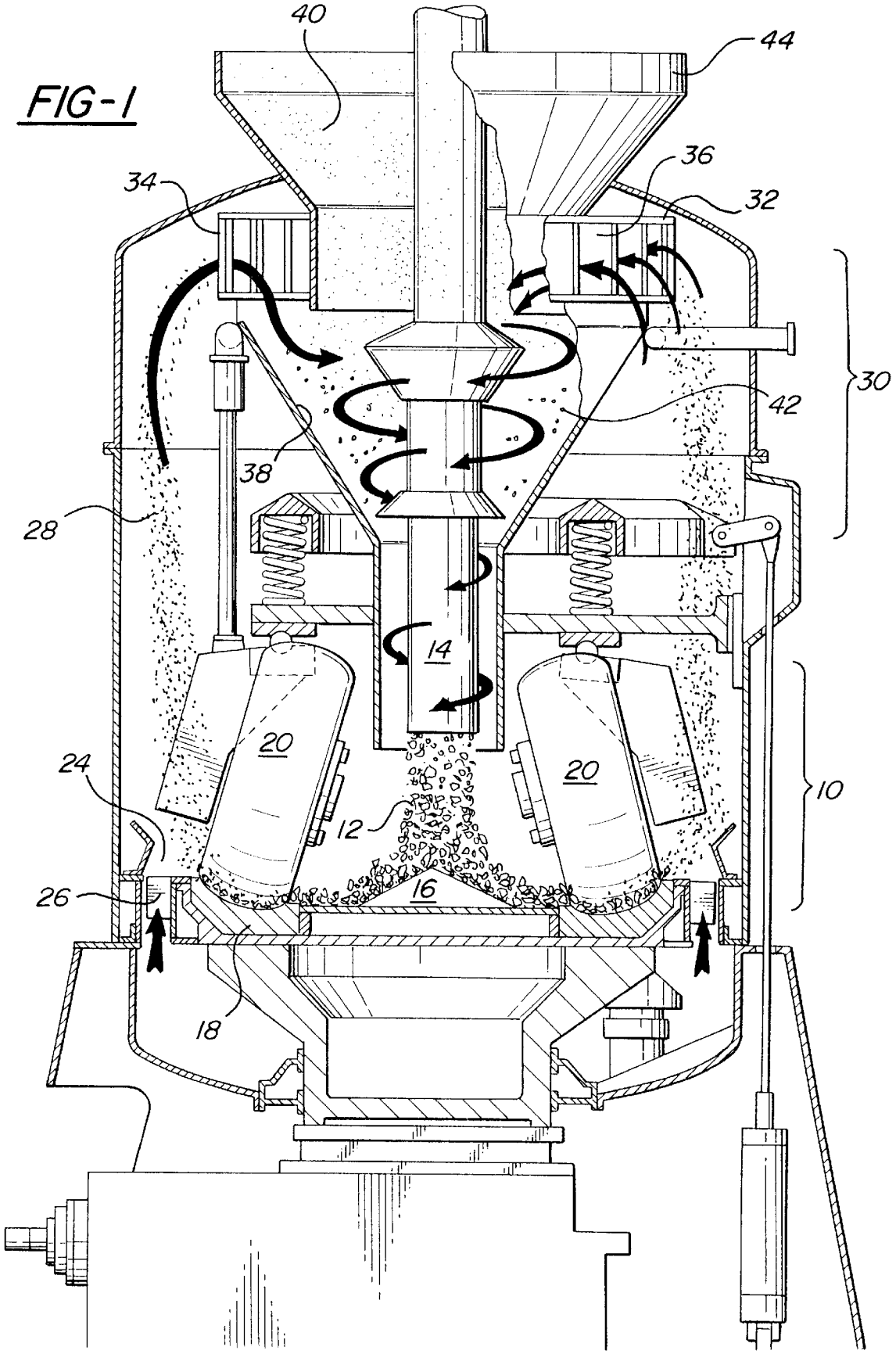
FIG. 1 is a side section view of a bowl mill type pulverizer with an associated classifier cone system, showing the flow of coal particles from the pulverizer through the classifying system.

Referring to FIG. 1, a pulverizer 10 and a classifier system 30 of known type are shown in section. In pulverizer 10 unground coal 12 is delivered from a feedpipe 14 to the middle of the pulverizer, where it is deflected by a diverter cap 16 radially outward onto a rotating grinding ring 18 to be crushed by grinding wheels 20. The direction of coal feed, bowl rotation and crushing action force the crushed coal "fines" over the edge of the grinding ring into a throat 24. Throat 24 is a circular, ring-shaped structure through which a steady stream of forced air flows upwardly from a known source (not shown), directed by a number of angled vanes 26 mounted in the throat around the circumference of the pulverizer. The resulting upwardly-directed air flow through throat 24 entrains and lifts the coal fines into a spiral flow 28 up and around the pulverizer to classifier structure 30.

For ease of explanation, the orientation of throat and classifier vanes and the resulting rotational flow direction are not intended to be specified in the side section view of FIG. 1, but are discussed below in views better suited to that purpose.

The rotating coal/air flow 28 from pulverizer 10 encounters a classifier cage 32, which defines a circumferential inlet 34 with a plurality of circumferentially-spaced classifier vanes 36. Vanes 36 direct the coal/air flow 28 from the pulverizer into a classifier cone 38. Inside the classifier cone 38 the centrifugal nature of the flow imparted to the coal from the classifier cage swirls the coal particles around the cone such that the smaller, lighter fines 40 are swirled up and out through a combustion outlet 44 to be burned. The larger particles 42, not yet suitable for burning, are separated centrifugally out and eventually drop through the bottom of the cone where they rejoin the flow from feedpipe 14 for regrinding.

It is known by those skilled in the art that the greater the centrifugal nature of the flow imparted to the coal fines as they enter the classifier cone, the better the cone classifies the differently sized fines, resulting in better uniformity of the coal fines delivered for combustion. The centrifugal flow tends to spiral the lighter, properly-sized fines up and out the combustion outlet 44, while forcing the heavier particles outward against the sides of the classifier cone, where they lose velocity and eventually drop out through the cone outlet 36 for regrinding.

Figure 1A:
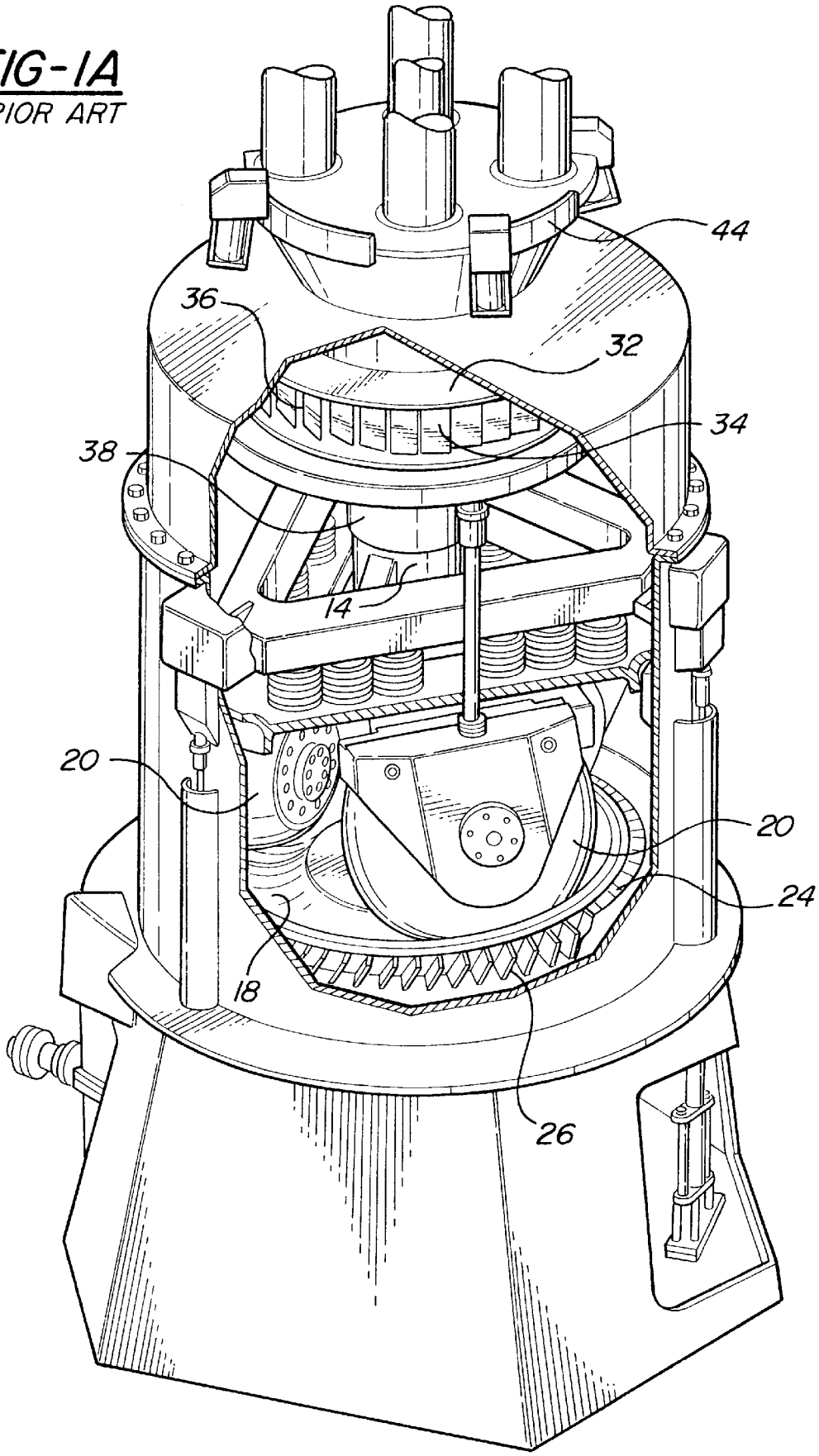
FIG-1A PRIOR ART
FIG. 1A is a perspective view, partially cut away, of a bowl mill type pulverizer incorporating a prior art classifier cage.
Figure 1B:
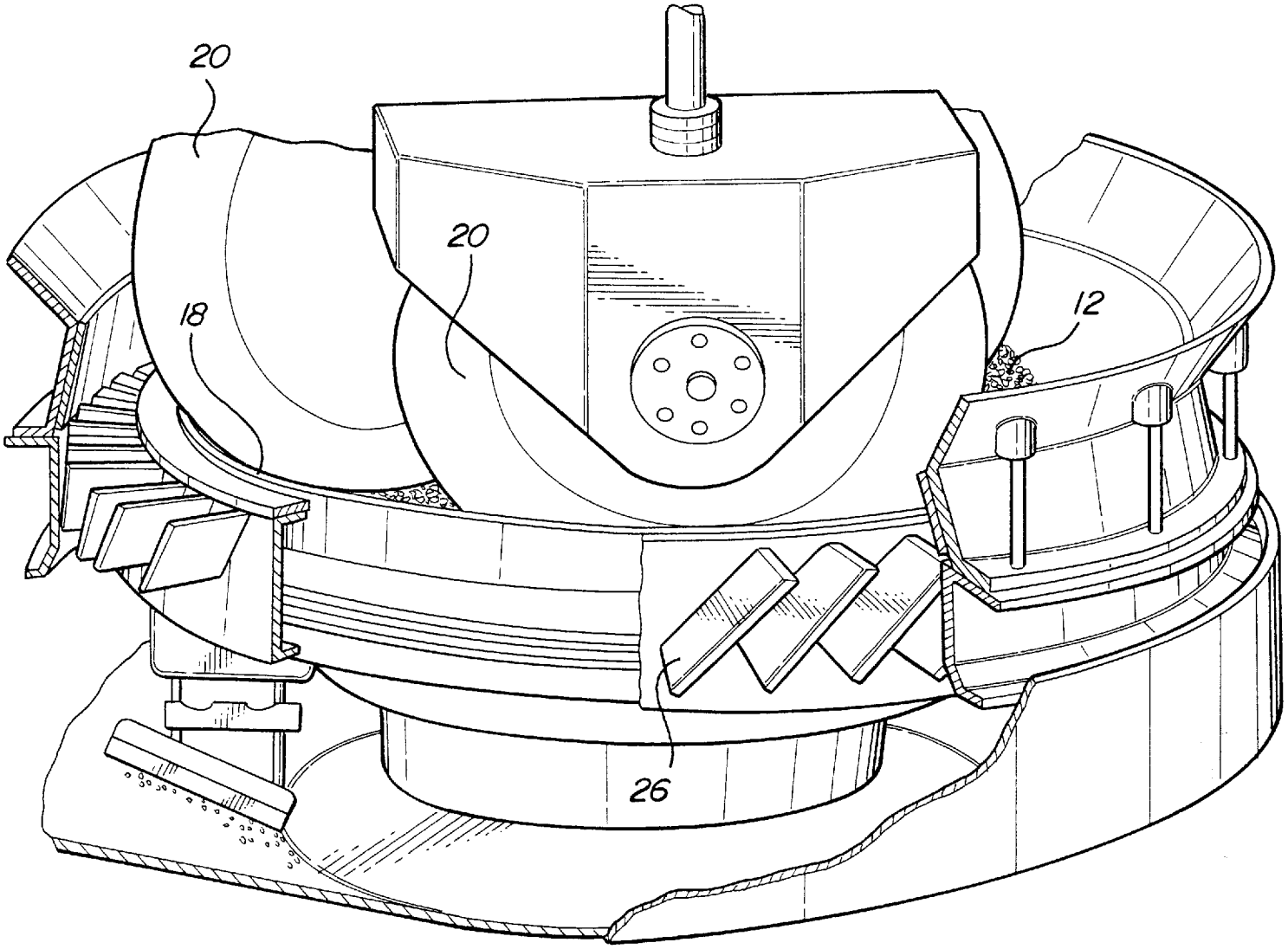
FIG. 1B is a detailed perspective view of the pulverizer throat vanes in FIG. 1A.

FIGS. 1A and 1B are perspective views of pulverizer and classifier structure 10, 30 similar to that shown in FIG. 1. FIG. 1*a* shows the relative angular orientation of throat vanes 26 in a rotating throat and the classifier vanes 36 in the cage. FIG. 1*b* shows the orientation of throat vanes 26 in more detail. The angular orientation of throat vanes 26 creates a spiral flow of air up and around the pulverizer with a rotational direction determined by the angle of vanes 26.

Figure 2:
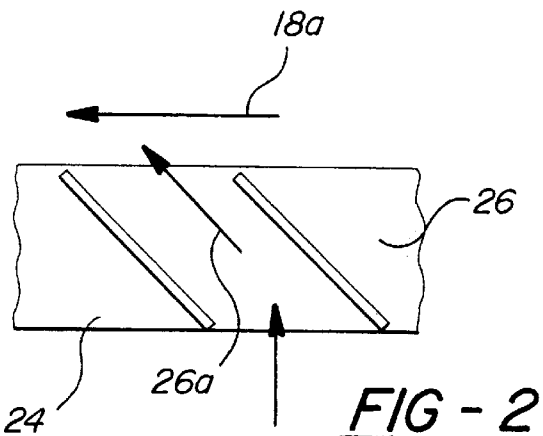
FIG. 2 is a schematic representation of a stationary pulverizer throat.

FIG. 2 is a schematic representation of a stationary pulverizer throat (viewed from outside the pulverizer) in which the grinding plate 18 rotates in a clockwise direction shown by arrow 18*a*, while throat 24 and vanes 26 remain stationary. The angular orientation of throat vanes 26 imparts a clockwise rotational flow direction to coal fines from the grinding ring, shown by arrow 26*a*.

Figure 3:
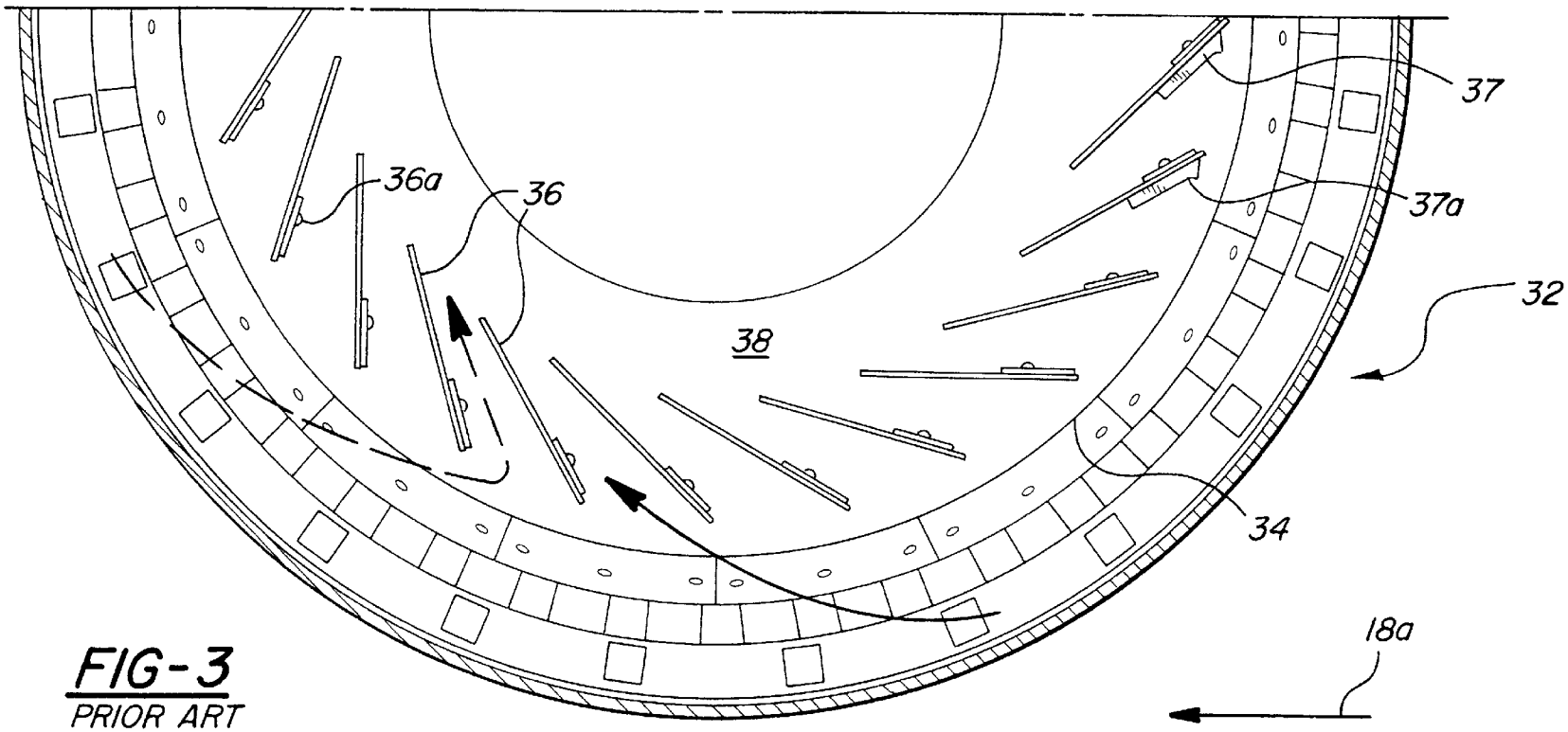
FIG-3 PRIOR ART
FIG. 3 is a plan view of a prior art classifier cage.

Referring now to FIG. 3, a prior art classifier cage 32 with classifier vanes 36 oriented for a stationary pulverizer throat is shown in plan view. Classifier cage 32 generally defines a circumferential inlet 34, with a plurality of classifier vanes 36 spaced circumferentially around the classifier cage in the inlet. Classifier vanes 36 are oriented in a direction originally set for the rotational flow (solid arrow) from a stationary pulverizer throat. Conversion to a rotating pulverizer throat (FIG. 4), however, results in a directional change for the air entering the inlet 34 of the classifier cage 32 (broken arrow). This reversal requires the coal/air flow to make a "U-turn" when it is guided by classifier vanes 36 into the classifier cone 38.

Two prior art attempts to improve control over the flow of coal/air entering the cone from the classifier cage 32 are illustrated in FIG. 3: classifier vanes 36 are of the slide-adjustable type described above, which can be lengthened or shortened; and, curved classifier vane attachments 37 are shown on the inlet end of some of the vanes 36, with a curved leading edge 37*a* designed to smooth and improve the reversal of flow direction by the vanes. Despite these attempts, the prior art classifier cage inherently has two disadvantages. First, whatever type of vane is used, the coal fines entering classifier cone 38 from a rotating pulverizer throat lose a significant amount of velocity when they are directionally reversed by vanes 36, reducing the effectiveness of the classifier cone in separating heavier coal particles from lighter fines. Second, even with slide adjustments on classifier vanes 36, the vanes cannot adjust the tangential flow direction of the coal, regardless of its velocity, to optimize the centrifugal/spiral flow around the sides of the classifier on the way down. Pivot-adjustable vanes are also known, some with built-in curvature (FIG. 6). They have likewise been found insufficient to compensate for reversed flow from a rotating throat.

Figure 4:
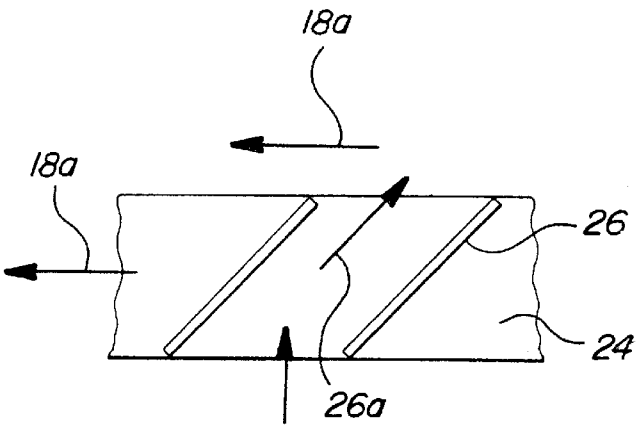
FIG. 4 is a schematic representation of a rotating pulverizer throat showing reversed air flow through the rotating vanes.

FIG. 4 is a schematic representation of a rotating pulverizer throat (viewed from outside the pulverizer) in which the grinding plate 18, throat 24 and vanes 26 rotate together in a clockwise direction shown by arrows 18*a*. The direction of throat vanes 26 is reversed from the direction of the stationary throat vanes shown in FIG. 2 to take advantage of the rotation and increase the efficiency of air flow. This, however, reverses the rotational directional of the air flow 26*a* from the throat, and hence the rotational direction of the coal fines entering the classifier cage is counterclockwise.

Figure 5:
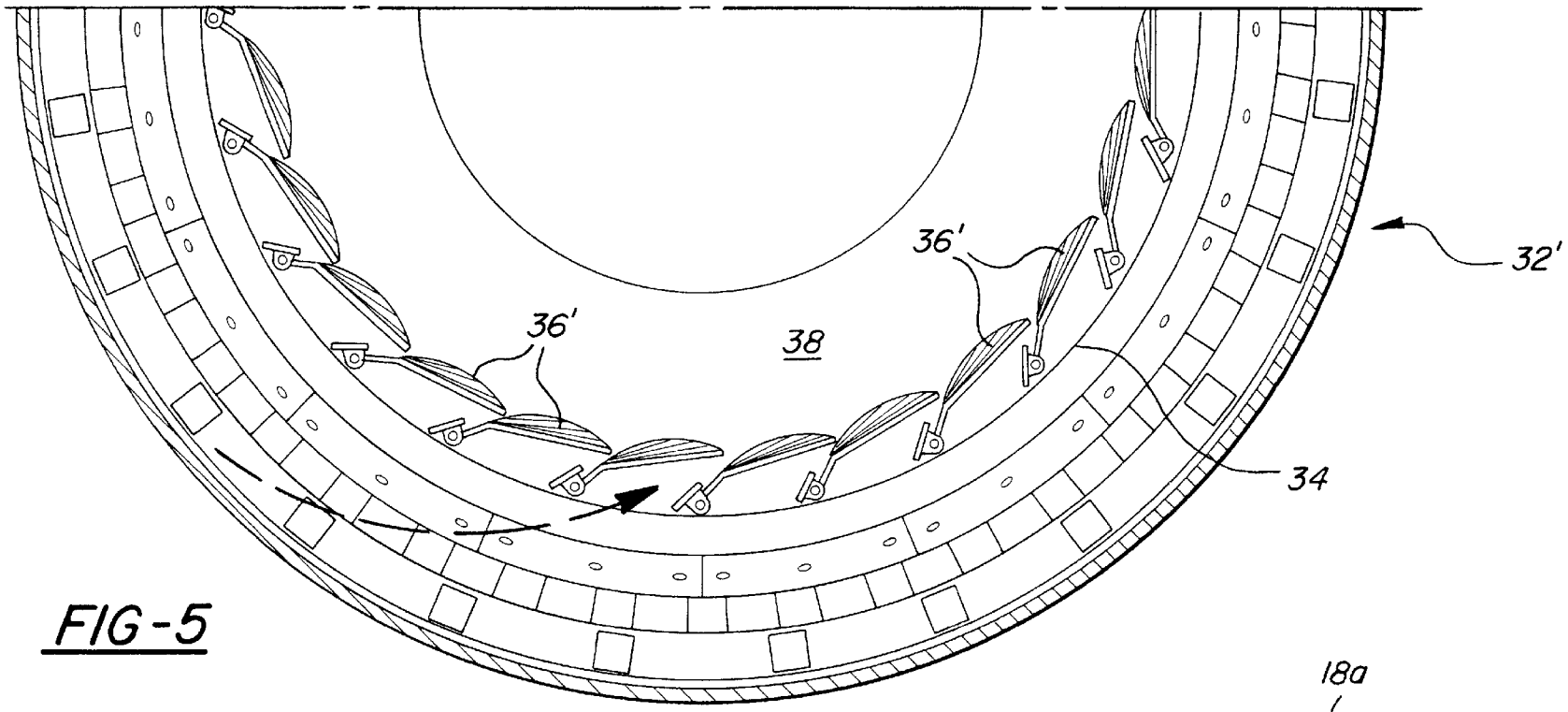
FIG. 5 is a plan view of a classifier cage according to the invention.

Referring now to FIG. 5, a plan view of an improved classifier cage 32' according to the present invention is shown with classifier vanes 36' whose direction has been reversed such that the rotational direction of the coal/air flow (counterclockwise broken arrow) from the rotating pulverizer throat through the classifier cage remains the same, with no reversal or "U-turn" as shown in FIG. 2. Accordingly, as the coal/air flow is directed down into classifier cone 38 by vanes 36', velocity remains higher for better centrifugal classifying action in the cone.

A further improvement to the classifier cage in FIG. 5 is an improved shape for classifier vanes 36'.

One type of prior art classifier vane is shown at 70 in FIG. 6, curved to better control and direct the coal/air flow entering the classifier cage. The prior art curved vane 70 has a tighter radius of curvature or "cup" at the upper end 71, the radius gradually increasing toward the bottom end 72 for a slight flare. The top edge is slightly longer than the bottom edge, such that when flat the vane is generally rectangular and slightly wider at the upper end 71. Besides being oriented in a direction which requires a U-turn for reversed flow from rotating pulverizer throats, the prior art curved vanes as shown in FIG. 6 do not adequately direct the coal/air flow in the desired downward and tangential manner.

Referring now to FIGS. 7 and 7A, an improved classifier vane according to the present invention is illustrated in use with the improved classifier vane orientation described above. When flat, the improved classifier vane 36' is generally trapezoidal with a wider lower end projecting further into the classifier cone. Illustrative vane 36' has a vertical inlet edge 50 (later attached to pivot bushing 50*a*), a top edge 51 essentially perpendicular to inlet edge 50, a short bottom edge 52 essentially parallel to top edge 51, an angled or curved contour edge 53 cut away to approximate the angle or curvature of the inside surface of the classifier cone, a bottom extension edge 54 essentially parallel to top edge 51, and a trapezoidal free edge 55 angled outwardly from top to bottom.

Improved classifier vane 36' has two primary bend lines 56, 57 defining two primary vane surfaces 59, 60 with complementary functions. In the illustrated embodiment bend lines 56, 57 represent angles of approximately 10°. These angles can be varied to accommodate different classifier operating parameters; however, in general, the angle or curvature of outer vane surface 60 relative to base portion 58 and the incoming coal/air flow will be greater than that of central vane surface 59. This is best shown in the plan view of FIGS. 5 and 7B.

Figure 7B:
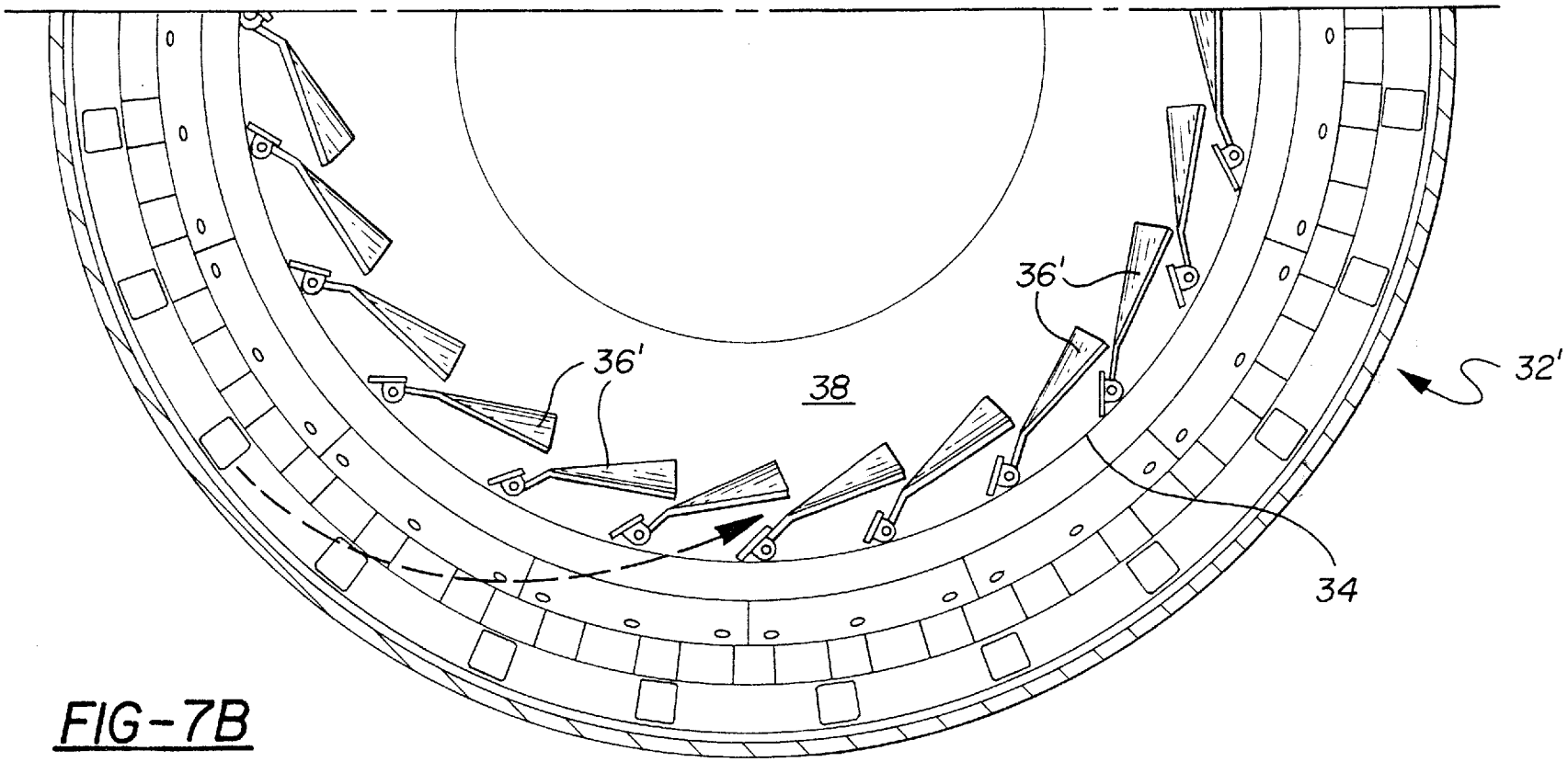
FIG. 7 is a perspective view of an improved classifier vane in use with a classifier cage according to the invention.
FIG. 7A is a front view of the vane of FIG. 7 laid flat; and, FIG. 7B is a plan view of a classifier cage according to the invention, with an alternate embodiment of the improved van eof FIGS. 5 and 7.

Central vane surface 59 may be essentially flat (planar) or curved, depending on the vane materials and the process used to bend it around line 56. The bend lines on surface 59 between 56 and 57 represent angle or curvature across surface 59. Outer vane surface 60 can likewise be planar or curved as desired. In the illustrated embodiment, vane surfaces 59, 60 are generally curved for a smooth, relatively constant transition across the vane as shown in FIG. 5. FIG. 7B is a plan view of an alternate (planar) embodiment.

It will be seen by comparison with the prior art curved vane of FIG. 6 that the region generally bounded by contour edge 53, bottom extension edge 54, and outer free edge 55 comprises a significant extension which projects both downwardly and inwardly into the classifier cone. This generally trapezoidal extension, along with the complementary angles of central and outer vane surfaces 59, 60, significantly increases directional control over the coal/air flow both downwardly into the classifier and tangentially relative to the classifier cone surface. In contrast to prior art vanes as shown in FIGS. 1*a*, 3 and 6, the extension projects below the lower edge 34*a* of circumferential inlet 34 of the classifier cage 32 to better move the coal/air flow downwardly into the classifier cone. The outwardly-angled free edge 55 helps create a "funnel" effect toward the lower end of vane 36'. The funnel-shaped central vane surface 59 widens toward the bottom of the vane to provide an increased ability to control the tangential directional component of flow. The outer vane surface 60 is eared over from the top at a greater angle to impart initial downward directional control to the flow, decreasing in width toward the bottom of vane 36' so as not to interfere with the tangential funneling action of surface 59 at the point of release.

It will be understood by those skilled in the art that the exact dimensions of the improved vanes according to the present invention can be varied to suit factors such as flow velocity, cone diameter, desired classifying results and related parameters to fine-tune the vanes for a particular application.

It will be apparent to those skilled in the art that the illustrated embodiment of the invention set forth above may be modified for different applications without departing from the scope of the claims. Accordingly,

We claim:

1. An improved classifier cage of the type used in rotating bowl mill coal pulverizers to direct a mixed flow of coal fines and air into a classifier cone, comprising:

a ring-shaped classifier cage having a circumferential inlet for receiving a rotational flow of coal fines from a rotating pulverizer throat in a first rotational direction which is opposite the direction of bowl rotation, an outlet for discharging the coal fines into the classifier cone, and a plurality of classifier vanes spaced circumferentially around the classifier cage between the inlet and outlet for directing the coal fines into a desired flow pattern around the interior of the cone, wherein the classifier vanes are oriented generally in the first rotational direction.

2. Apparatus as defined in claim 1, further including an improved classifier vane having a generally trapezoidal outer edge widening toward the lower end of the vane.

3. Apparatus as defined in claim 2, wherein the trapezoidal outer edge is extended below the level of the classifier cage inlet to form a coal-directing extension extending downwardly and inwardly into the classifier cone.

4. Apparatus as defined in claim 3, wherein the extension includes an interior portion cut away to match the contour of an adjacent surface of the classifier cone.

5. Apparatus as defined in claim 2, wherein the vane comprises a central vane surface set at a first angle relative to the flow of coal fines past the vane, and an outer vane surface set at a second greater angle relative to the flow of coal fines past the vane.

6. Apparatus as defined in claim 5, wherein the first vane surface widens in funnel fashion from top to bottom for improved tangential flow control, and the outer vane surface narrows from top to bottom for improved downward flow control without interfering with tangential flow control at the lower end of the vane.

7. Apparatus as defined in claim 5, wherein the central and outer vane surfaces are essentially planar.

8. Apparatus as defined in claim 5, wherein the central vane surface is curved.

9. Apparatus as defined in claim 8, wherein the outer vane surface is curved.

10. An apparatus as defined in claim 5, wherein the improved classifier vane is mounted for sliding adjustment on the classifier cage.

11. An apparatus defined in claim 5, wherein the improved classifier vane is mounted for pivoting adjustment on the classifier cage.

12. A method for improving a classifier cage of the type used in rotating bowl mill coal pulverizers to direct a mixed flow of coal fines and air into a classifier, comprising the following steps:

providing a ring-shaped classifier cage having a circumferential inlet for receiving a rotational flow of coal fines from a rotating pulverizer throat in a first rotational direction which is opposite the direction of bowl rotation, an outlet for discharging the coal fines into the classifier, and a plurality of classifier vanes spaced circumferentially around the classifier cage between an inlet and outlet for directing the coal fines into a desired flow pattern around the interior of the cone; and reversing the orientation of classifier vanes from a first direction generally aligned opposite the first rotational direction, to a direction generally aligned with the first rotational direction.

13. An improved classifier cage of the type used in rotating bowl mill coal pulverizers to direct a mixed flow of coal fines and air into a classifier, comprising:

a classifier cage having a plurality of classifier vanes, wherein the flow direction of the classifier vanes is reversed to match the rotational flow from a rotating pulverizer throat with reversed flow direction.

* * * * *

UNITED STATES PATENT AND TRADEMARK OFFICE

CERTIFICATE OF CORRECTION

PATENT NO. : 5,819,947

DATED : October 13, 1998

INVENTOR(S) : Nardi et al.

It is certified that error appears in the above-indentified patent and that said Letters Patent is hereby corrected as shown below:

Column 2, line 10, delete "optional" and insert --optimal--;

Column 3, line 22, delete "van eof" and insert --vane of--;

Column 3, line 57, delete "out" and insert --outward--;

Column 4, line 4, delete "10, 30";

Column 4, line 29, after "u-turn", add --(broken arrow)--;

Column 4, line 36, after "shortened", add --with a known slide adjustment mechanism at 36a--.

Signed and Sealed this

Twenty-fourth Day of August, 1999

*Attest:*

Q. TODD DICKINSON

*Attesting Officer*

*Acting Commissioner of Patents and Trademarks*